US005956979A

United States Patent [19]

Collins et al.

[11] Patent Number: 5,956,979

[45] Date of Patent: Sep. 28, 1999

[54] LOCK-LESS EQUIPMENT CABLE SECURITY SYSTEM

[76] Inventors: Joddy Van Collins, 8821 Kelso La., Chattanooga, Tenn. 37421; Hugh Lee Worthy, 370 N. Moore Rd., Rising Fawn, Ga. 30738

[21] Appl. No.: 08/959,170

[22] Filed: Oct. 28, 1997

[51] Int. Cl.[6] ..... E05B 73/00

[52] U.S. Cl. ..... 70/18; 70/58; 24/129 R

[58] Field of Search ..... 70/18, 58, 14–17; 24/298, 302, 129 R

[56] References Cited

U.S. PATENT DOCUMENTS

| | | | |
|---|---|---|---|
| 860,189 | 7/1907 | Chatfield | 24/129 R |
| 1,272,272 | 7/1918 | Kell | 24/129 R |
| 3,744,281 | 7/1973 | Logue et al. | 70/58 |
| 3,800,575 | 4/1974 | Perret, III | 70/58 |
| 4,366,605 | 1/1983 | McKenney | 70/58 |
| 4,896,519 | 1/1990 | Pitts | 70/18 |
| 5,095,722 | 3/1992 | Chapmond et al. | 70/18 |
| 5,501,494 | 3/1996 | Willetts | 292/288 |
| 5,595,073 | 1/1997 | Sullivan | 70/18 |

*Primary Examiner*—Darnell M. Boucher
*Attorney, Agent, or Firm*—Joddy V. Collins

[57] ABSTRACT

A Lock-less Equipment Cable Security System (LECS) is used to secure from theft equipment loaded on vehicles with locking compartments. The cable can be used to secure equipment to any facility or equipment that has a hollow compartment large enough to enclose the balls, with a lockable cove door, lid, or window and physical space tolerance for the cable insertion through the closure. A plastic-coated steel security cable without attachments such as cable end-collars and security locks is threaded through equipment loaded on a vehicle. Then each cable end is threaded through a solid ball manufactured with 2 holes drilled at an angle and size sufficiently small to prevent the cable from releasing the balls when pulled on. The cable ends with attached balls are then locked in a vehicle compartment, securing the loaded equipment. The balls have holes drilled in them in such a manner that they will not detach from the cable without being held and the cable unthreaded. The balls' physical size prevents them from being pulled through a door, hood, or trunk closure seam.

1 Claim, 3 Drawing Sheets

LOCK-LESS EQUIPMENT CABLE SECURITY SYSTEM

BACKGROUND OF THE INVENTION

1. Field of the Invention

This invention is related to theft-deterrent devices for equipment carried on the exterior of automobiles. In this device class specifically, it is related to tether-type theft deterrents for boats, canoes, kayaks, and bicycles carried on automobiles.

2. Description of Related Art

U.S. Pat. No. 5,095,722—CHAPMOND; U.S. Pat. No. 3,744,281—LOGUE AND KOLATH,; U.S. Pat. No. 4,366,605—MCKENNEY; U.S. Pat. No. 3,800,575—PERRET; U.S. Pat. No. 4,896,519—PITTS; U.S. Pat. No. 5,501,494—WILLETTS.

Presently available devices used to secure equipment on automobiles utilize some type of flexible steel tether to secure equipment from theft. The tether may be padlocked to the vehicle or vehicle carrier racks with permanent loops securing the protected item, as in U.S. Pat. No. 5,095,722—Chapmond. The tether may be a thin metal sheet or have permanent loops with some type of metal clip that fits over the side-window glass, which is then closed as in U.S. Pat. Nos. 3,744,281—Logue and 4,366,605—McKenney. The tether may have a permanent enlarged end that is inserted through the protected equipment and padlocked to its self as in U.S. Pat. No. 3,800,575—Perret. The tether may have permanent loops that secure it to the vehicle and padlocked equipment, as in U.S. Pat. No. 4,896,519—Pitts. Last, the tether may have a permanent, enlarged end that may be inserted between the door and door jamb, so the door may be closed on the tether and locked as in U.S. Pat. Nos. 4,366,605—McKenney, and 4,896,519—Willetts.

Our LECS theft deterrent device is simply a plastic-coated steel cable with two attachable and detachable cable stops. LECS is unique since it has three features not addressed by the previous art of cable theft deterrents. The first unique feature is the cable has no enlargements or loops of any kind on it, so it can be threaded through any small equipment opening larger than the cable diameter; such as the small clearance between a kayak seat and hull. The second unique feature is the "enlargements, cable stops, or balls" that keep the cable from being freed from the automobile, are attachable and detachable. The third unique feature is the "enlargements, cable stops, or balls" are attached by inserting the cable through 2 holes drilled in the balls in such a way that the stress, tension and friction produced by the bend in the cable prevents the release of the balls. None of the prior art suggests a tether with no permanent loops or collars and detachable "enlargements, cable stops, or balls" where both ends of the tether are inserted between the automobile door and door jamb, so the door(s) may be closed on the tether ends and locked.

BRIEF SUMMARY OF THE INVENTION

The object of the Lock-less Equipment Cable Security (LECS) System invention is to provide easy-to-use, cable security to deter theft for equipment carried on automobiles, like kayaks.

The device consists of a plastic-coated steel cable that is threaded through and around loaded equipment, for example between the kayak seat and hull, or through a bicycle frame. Two balls are then attached to the ends of the cable by inserting each cable end through both holes in each ball. The cable ends are secured by putting them inside a vehicle compartment, for example the passenger compartment, and shutting and locking the door, hood, or trunk on the cable, so that the cable ends are between the doorjamb and door. Thus, the only lock needed to release the cable is the vehicle lock.

BRIEF DESCRIPTION OF THE DRAWINGS

FIG. 1 is the entire lockless equipment cable security system consisting of a plastic-coated steel cable and 2 solid balls with holes drilled in such a manner as to prevent the cable ends from slipping when pulled on.

DETAILED DESCRIPTION OF THE PREFERRED EMBODIMENTS

Figure 1:
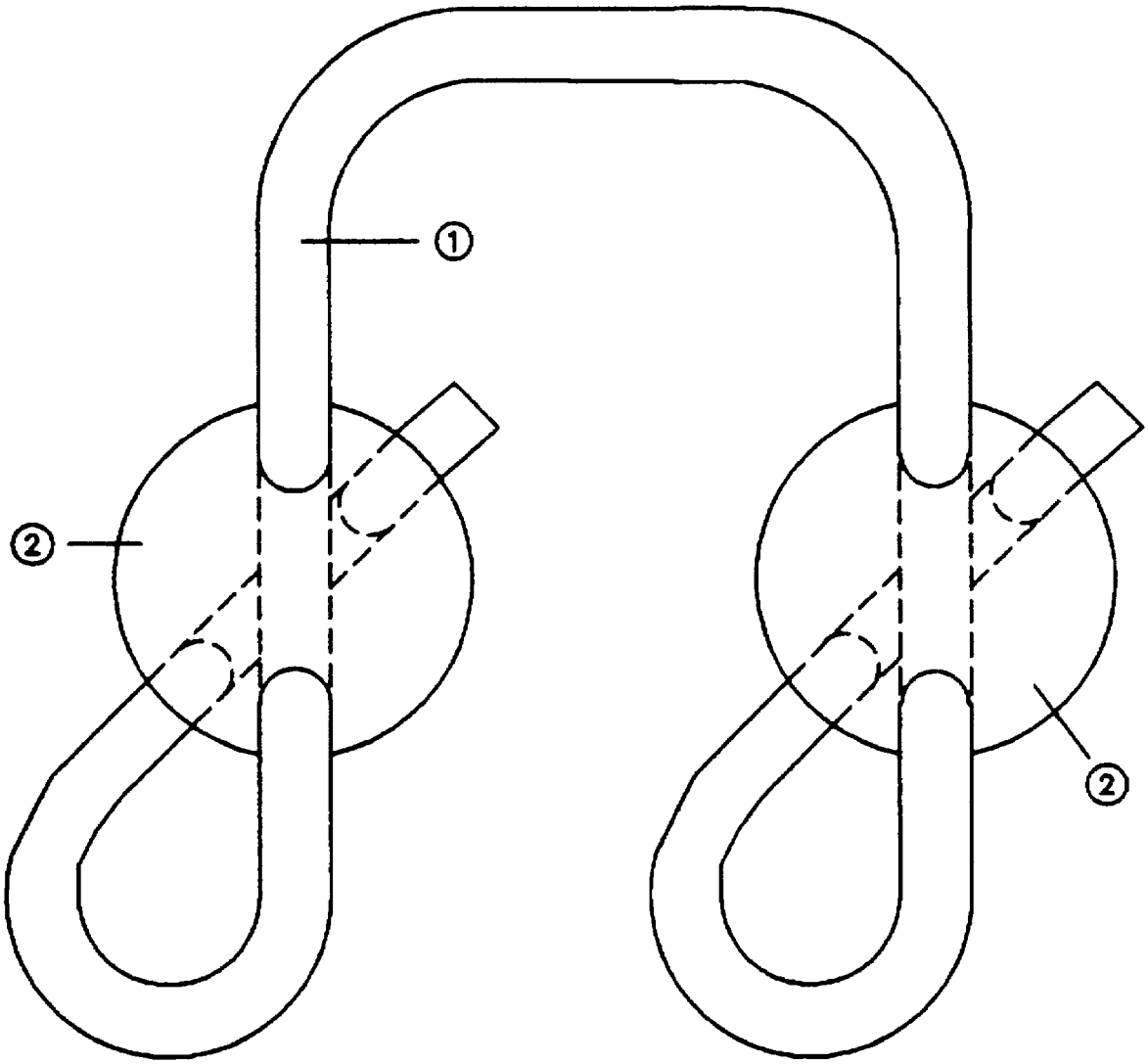
Figure 2:
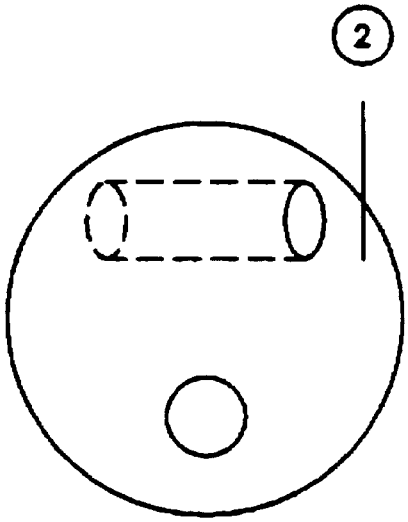
FIG. 2 is the detailed isometric top view of the ball for manufacturing purposes.
Figure 3:
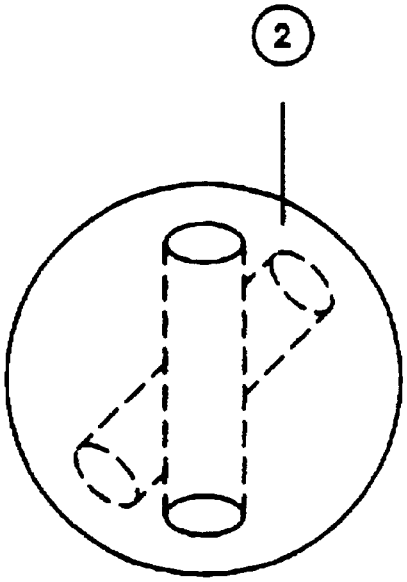
FIG. 3 is the detailed isometric front view of the ball for manufacturing purposes.
Figure 4:
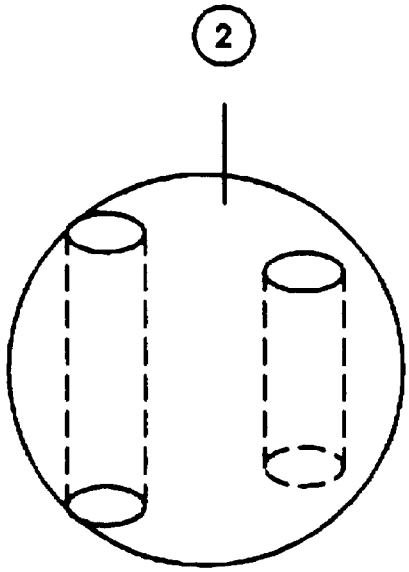
FIG. 4 is the detailed isometric right-side view of the ball for manufacturing purposes.

In FIG. 1, the device consists of a plastic-coated steel cable 1 that has each end inserted through two holes in each ball 2.

The balls 2 should be solid and made of any material such as wood, plastic, rubber, metal, or ceramics that will not break or deform when stressed by a force pulling on the cable or impact against a barrier. They should have a diameter such that their physical size prevents them from being pulled through the space tolerance between vehicle doors, hoods, and trunks and the vehicle body.

They should have holes drilled or molded in such a way that the stress, tension and friction produced by the bend in the cable prevents the release of the balls, until the cable is loosened and the bend is enlarged to reduce the stress, tension and friction.

Figure 5:
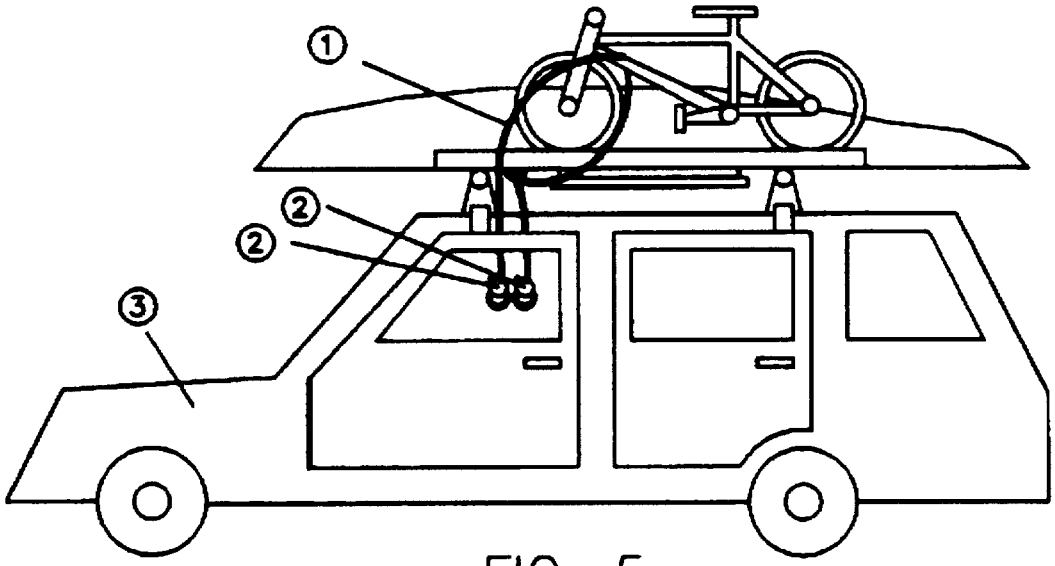
FIG. 5 is a perspective view of a kayak and bicycle mounted on a car roof rack, secured from theft with the invention.
Figure 6:
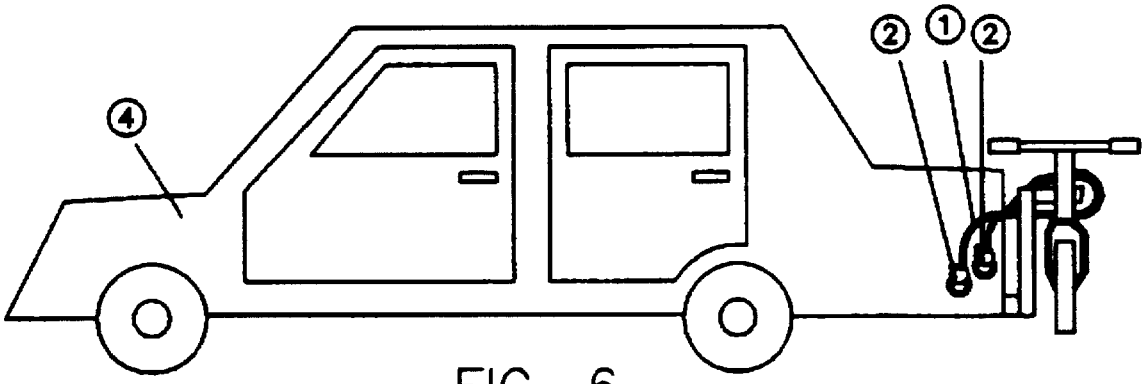
FIG. 6 is a perspective view of a bicycle mounted on a car bumper rack, secured from theft with the invention.
Figure 7:
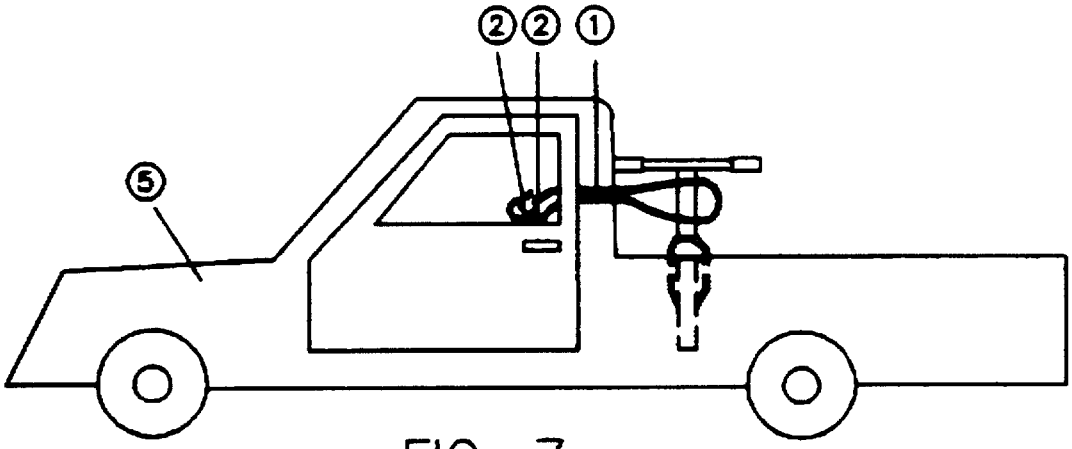
FIG. 7 is a perspective view of a bicycle mounted in a pickup truck bed, secured from theft with the invention.

In FIG. 5, the cable 1 is threaded through the bicycle frame and between the kayak seat and hull, and the cable ends with balls 2 attached are locked in the passenger compartment of the automobile 3. In FIG. 6, the cable 1 is threaded through the bicycle frame, and the cable ends with balls 2 attached are locked in the trunk compartment of the automobile 4. In FIG. 7, the cable 1 is threaded through the bicycle frame, and the cable ends with balls 2 attached are locked in the passenger compartment of the pickup truck 5.

We claim:

1. A lock-less, theft-deterrent device for tethering equipment carried on the outside of an automobile to the automobile comprising:

a length of cable without enlargements, loops, or collars at its ends, said cable is adapted to be inserted through an opening in the equipment and looped around the equipment to secure the equipment to the automobile;

a first attachable and detachable ball, said first ball having two holes extending therethrough, said first ball is secured to one end of the cable by inserting said end of the cable through said two holes in said first ball;

a second attachable and detachable ball, said second ball having two holes extending therethrough, said second ball is secured to the other end of the cable by inserting said other end of the cable through said two holes in said second ball;

whereby both ends of the cable with balls attached is capable of being inserted inside a compartment of the automobile and upon closing and locking the door of the automobile the cable is located between the door-jamb and the door and the balls are locked within the compartment.

* * * * *